US009176470B2

(12) United States Patent
Kondo

(10) Patent No.: US 9,176,470 B2
(45) Date of Patent: Nov. 3, 2015

(54) IMAGE FORMING APPARATUS AND EXHAUST DUCT

(71) Applicant: KYOCERA Document Solutions Inc., Osaka (JP)

(72) Inventor: Kazuhisa Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/256,257

(22) Filed: Apr. 18, 2014

(65) Prior Publication Data

US 2014/0321878 A1 Oct. 30, 2014

(30) Foreign Application Priority Data

Apr. 25, 2013 (JP) ..... 2013-092822

(51) Int. Cl.
*G03G 21/20* (2006.01)
*B41J 2/175* (2006.01)
*B41J 11/20* (2006.01)

(52) U.S. Cl.
CPC ..... *G03G 21/206* (2013.01); *B41J 2/175* (2013.01); *B41J 2/17563* (2013.01); *B41J 11/20* (2013.01)

(58) Field of Classification Search
CPC ..... G03G 21/206; G03G 2221/1645
See application file for complete search history.

(56) References Cited

U.S. PATENT DOCUMENTS

| | | | | |
|---|---|---|---|---|
| 4,536,198 | A * | 8/1985 | Strain | 95/125 |
| 6,328,442 | B1 | 12/2001 | Brinkly | |
| 6,544,320 | B2 * | 4/2003 | Wong | 96/240 |
| 2007/0065171 | A1 | 3/2007 | Koshimura et al. | |
| 2009/0290897 | A1 * | 11/2009 | Doshoda et al. | 399/93 |
| 2012/0016461 | A1 * | 1/2012 | Harman | 623/1.15 |

FOREIGN PATENT DOCUMENTS

| | | | | |
|---|---|---|---|---|
| GB | 862070 | * | 3/1961 | F15C 1/16 |
| GB | 862070 | A * | 3/1961 | |
| JP | 2001-239680 | A | 9/2001 | |
| JP | 2007-086436 | A | 4/2007 | |
| JP | 2009-291977 | A | 12/2009 | |
| JP | 2010-224017 | A | 10/2010 | |
| JP | 2011-227315 | A | 11/2011 | |

* cited by examiner

*Primary Examiner* — Clayton E LaBalle
*Assistant Examiner* — Victor Verbitsky
(74) *Attorney, Agent, or Firm* — Studebaker & Brackett PC

(57) ABSTRACT

An image forming apparatus includes a filter and an exhaust duct. The filter filters and ejects an air. The exhaust duct flows and ejects the air to the filter. The exhaust duct also includes a plurality of partition plates alternately arranged along an exhaust direction on one side inner face and another side inner face facing to each other. The plurality of the partition plates has the partition plate formed so as to incline in an opposite direction to the exhaust direction.

5 Claims, 6 Drawing Sheets

IMAGE FORMING APPARATUS AND EXHAUST DUCT

INCORPORATION BY REFERENCE

This application is based on and claims the benefit of priority from Japanese Patent application No. 2013-092822 filed on Apr. 25, 2013, the entire contents of which are incorporated herein by reference.

BACKGROUND

The present disclosure relates to an image forming apparatus including an exhaust duct collecting particulates and the exhaust duct.

In an image forming apparatus, particulates, such as an ink or a toner, may be floated and scattered inside the apparatus. In order to collect the floated particulates, the image forming apparatus includes, for example, a fan, an exhaust duct and a filter. In the image forming apparatus, an air inside the apparatus is sucked by a fan, guided to the filter by the exhaust duct and cleaned by the filter, and then, ejected outside the apparatus.

As one example of the image forming apparatus, an inkjet printing apparatus is configured to include a noise silencer removing an ink particle with a filter. Inside the noise silencer, a baffle wall is arranged and formed so as to partially flow an air and to facilitate flowing some air on the surface.

Another example of the image forming apparatus is configured to include a developer sucking device sucking and collecting a developer floated in developing. The developer sucking device has an air duct and the duct is provided with libs respectively arranged to one inside wall face and another inside wall face facing to each other. One lib is shifted from another lib in a flowing direction of the air duct, i.e., these libs are alternately arranged to compose one developer collecting box. An area of an inflow port of the developer collecting box is 10-25 percent of a cross-section area of an air path of the air duct.

A further example of the image forming apparatus is configured to include a developing device to which a floated toner collecting device. The floated toner collecting device has a sucking duct having a plurality of toner catching protruded parts inside. Each toner catching protruded part is protruded from an upstream side end to a downstream side end in an air current direction in the sucking duct and upward from a bottom wall face in the duct. The toner catching protruded part has a difference recessed to the bottom wall face in the duct at the downstream side end.

However, in the above-mentioned one example's image forming apparatus, in order to make the baffle wall function as the filter, it is necessary to configure a plurality of the baffle walls so as to individually interrupt a half or more of the air path cross-section in the noise silencer so that many air hits against the plurality of the baffle walls. Therefore, since the air flowing in the noise silencer receives great pressure drop by the baffle walls, it is necessary to apply the fan having large air volume. In addition, since the fan having large air volume is used, there is a possibility of loudening noise and increasing energy consumption. Moreover, since this baffle wall has a vertical shape and is formed to facilitate flowing of the air on the surface, it is difficult to generate vortex collecting the particulates.

In the above-mentioned other example's image forming apparatus, the developer collecting box is configured by alternating two libs bent in a U-shape. However, in this configuration, the libs interrupt a half or more of the air path cross-section in the air duct. Therefore, since the air flowing in the air duct receives great pressure drop by the libs, it is necessary to apply the fan having large air volume and there is a possibility of loudening noise and increasing energy consumption by the fan having large air volume. Moreover, since this lib has a vertical shape, it is difficult to generate vortex collecting the particulates.

Incidentally, if a capacity of the exhaust duct were increased in order to decrease the pressure drop of the air flowing, it is necessary to secure wide space used for arrangement of the exhaust duct inside the image forming apparatus, and then, the apparatus is enlarged.

In the above-mentioned further example's image forming apparatus, the toner catching protruded part protruded on the inside wall face of the sucking duct is formed with a right angled triangle cross-section higher at the upwind side so that vortex is generated in the vicinity of the right angled part and the particulates are accumulated. However, in an air path generated in this sucking duct, the air is directly flowed from an inlet port to an outlet port without receiving an influence of the toner catching protruded part. In this air path, the particulates are not decelerated and are directly sucked to the filter. Therefore, there are possibilities that the particulates hit the filter to damage the filter and the filter is clogged by the particulates. Incidentally, if the fan having small air volume were applied in order to prevent such a phenomenon, since the air volume is insufficient, the vortex is not generated in the toner collecting protruded part and the particulates cannot be collected in the duct.

In addition, if the fan having small air volume were applied in order to prevent such a phenomenon, there is a possibility of insufficiently collecting the particulates inside the apparatus. Moreover, for example, if the fan having small air volume were applied in order to absorb a sheet to a conveyance belt in the image forming apparatus, there is a possibility of inappropriately absorbing the sheet and inappropriately conveying the sheet.

SUMMARY

In accordance with an embodiment of the present disclosure, an image forming apparatus includes a filter and an exhaust duct. The filter filters and ejects an air. The exhaust duct flows and ejects the air to the filter. The exhaust duct also includes a plurality of partition plates alternately arranged along an exhaust direction on one side inner face and another side inner face facing to each other. The plurality of the partition plates has the partition plate formed so as to incline in an opposite direction to the exhaust direction.

In accordance with an embodiment of the present disclosure, an exhaust duct includes a plurality of partition plates. The plurality of the partition plates are alternately arranged along an exhaust direction on one side inner face and another side inner face facing to each other. The plurality of the partition plates also has the partition plate formed so as to incline in an opposite direction to the exhaust direction.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, with reference to FIGS. 1 to 3, the entire structure of a color printer 1 (hereinafter, called as a "printer 1") as an image forming apparatus will be described. Hereinafter, a near side (a reader's side) of FIG. 1, a far side (a depth side) of FIG. 2 and a left hand side of FIG. 3 will be described as the front side of the printer 1 and an arrow Fr in FIG. 3 indicates the front side of the printer 1.

Figure 1:
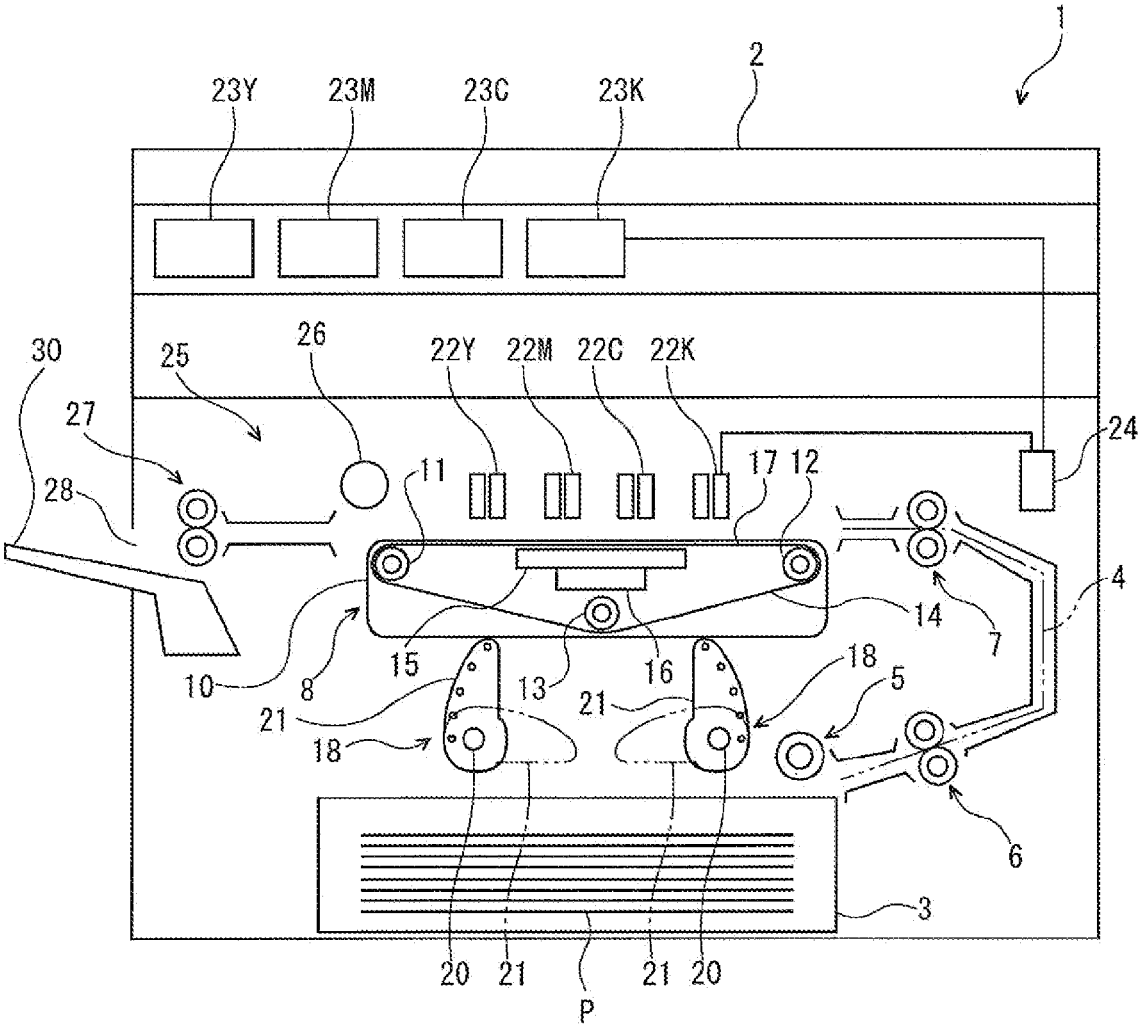
FIG. 1 is a schematic diagram schematically showing a printer according to an embodiment of the present disclosure.

As shown in FIG. 1, the printer 1 includes a box-like formed printer main body 2. In a lower part of the printer main body 2, a sheet feeding cartridge 3 storing a sheet P is installed pullably.

In a right side part of the printer main body 2, a conveying path 4 for the sheet P is arranged. At a lower end part of the conveying path 4, a sheet feeding roller 5 is positioned near the sheet feeding cartridge 3 and, at the right side of the sheet feeding roller 5, conveying rollers 6 are positioned. At an upper end part of the conveying path 4, resist rollers 7 are positioned.

In an intermediate part of the printer main body 2, an upward/downward movable conveying unit 8 is provided. The conveying unit 8 includes a conveyance frame 10, a driving roller 11, a following roller 12, a tension roller 13, an endless conveyance belt 14, a sucking part 15 and an exhaust part 16.

The driving roller 11 is rotatably supported at a left upper corner of the conveyance frame 10. The following roller 12 is rotatably supported at a right upper corner of the conveyance frame 10. The tension roller 13 is rotatably supported at an intermediate lower part of the conveyance frame 10.

The conveyance belt 14 is wound around the driving roller 11, following roller 12 and tension roller 13. In an upper face of the conveyance belt 14, a roughly flat conveyance face 17 is formed. The conveyance belt 14 has a lot of air intake holes (not shown).

The sucking part 15 and exhaust part 16 are located so as to be surrounded by the conveyance belt 14. The sucking part 15 is arranged close to a lower side of the conveyance face 17 of the conveyance belt 14. The exhaust part 16 is arranged below the sucking part 15.

Figure 2:
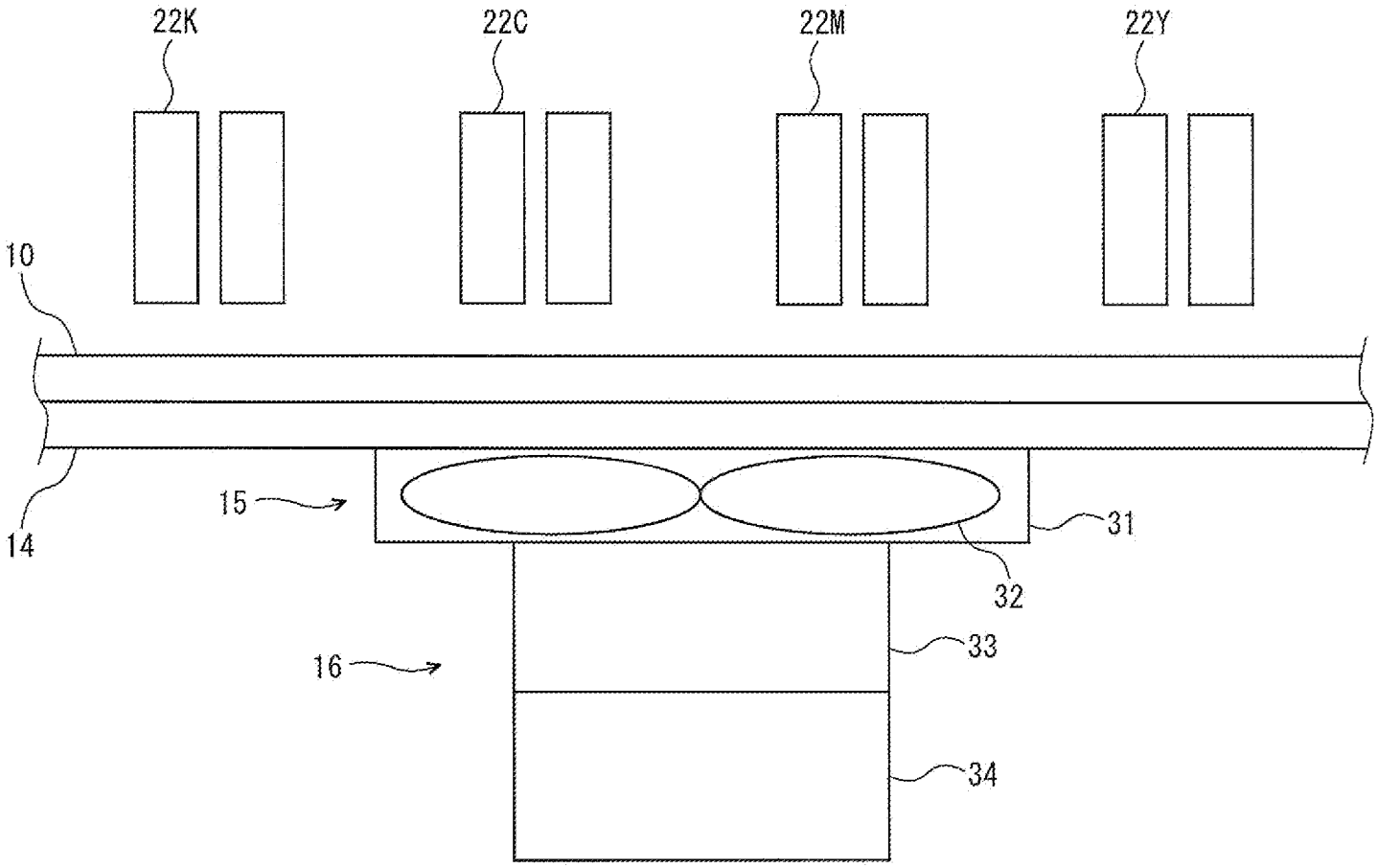
FIG. 2 is a backward sectional view schematically showing a mechanism in the vicinity of an exhaust part of the printer according to the embodiment of the present disclosure.
Figure 3:
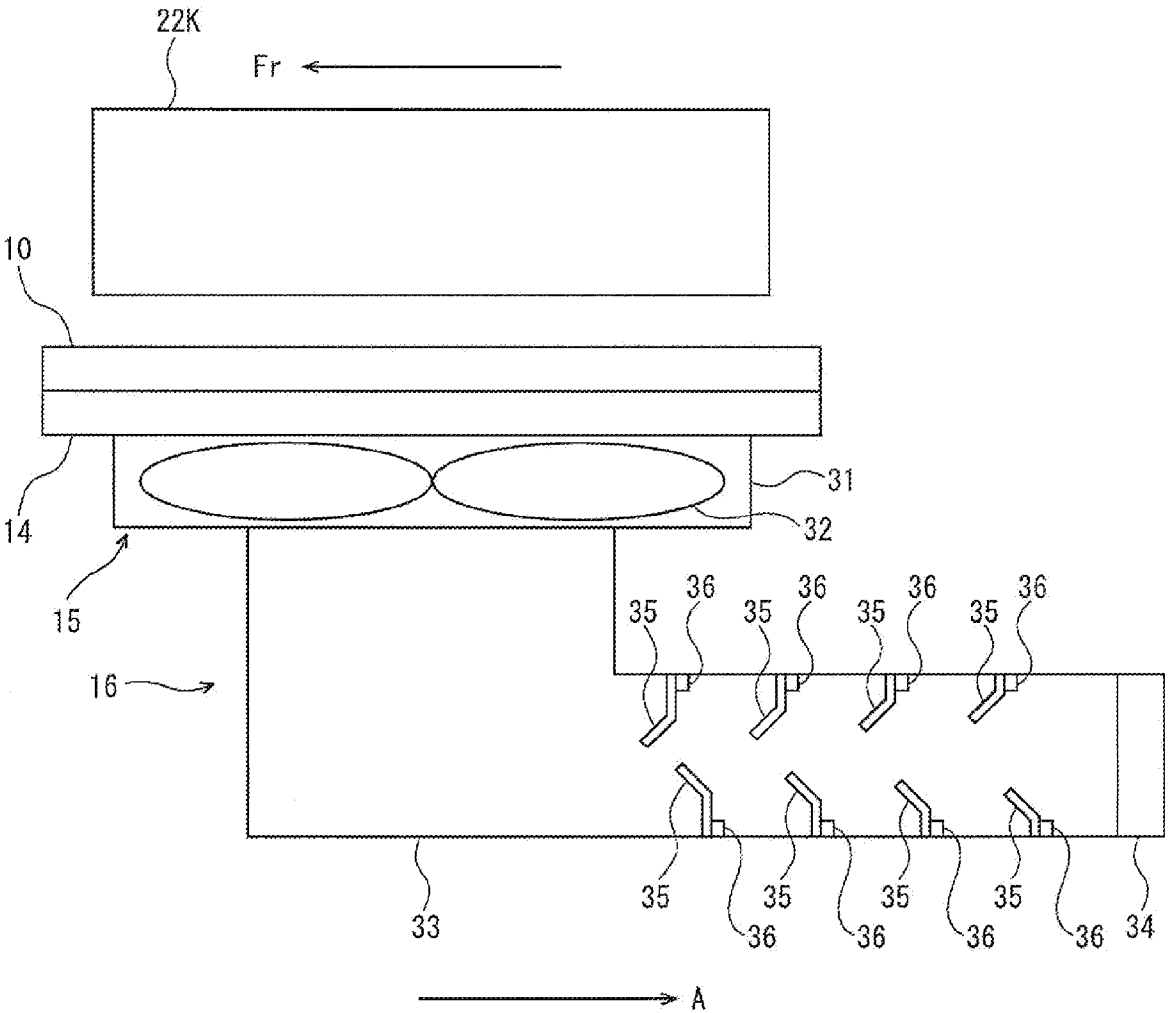
FIG. 3 is a rightward sectional view schematically showing the mechanism in the vicinity of the exhaust part of the printer according to the embodiment of the present disclosure.

As shown in FIGS. 2 and 3, the sucking part 15 is provided with sucking components, such as a fan 32, in a casing 31. The casing 31 is communicated with an exhaust duct 33 of the exhaust part 16. For example, the casing 31 has a lot of openings (not shown), such as air intake holes, in a conveyance belt 14's side face (an upper face). That is, the sucking part 15 is configured to suck an outside air from the openings of the casing 31 by the fan 32 and to eject the air to the exhaust part 16.

The exhaust part 16 is provided with the exhaust duct 33 and a filter 34. A proximal end of the exhaust duct 33 is communicated with the casing 31 of the sucking part 15. To a distal end of the exhaust duct 33, the filter 34 is attached. The exhaust part 16 flows the air sent from the sucking part 15 through the exhaust duct 33, filters the air by the filter 34, and then, ejects the air.

The exhaust duct 33 is formed by bending a square cylindrical member in an L-shape in side view. A lower part of the exhaust duct 33 is extended backward from a position surrounded by the conveyance belt 14 and projected outside the conveyance belt 14. That is, the exhaust duct 33 has an exhaust direction A toward the back side. At the downwind side from the bent portion in the exhaust direction A of the exhaust duct 33, a plurality of partition plates 35 are arranged alternately along the exhaust direction A on an upper inner face and a lower inner face. To each partition plate 35, a heating member 36 is attached.

The plurality of the partition plates 35 are plate-like members formed so as to partition the inside of the exhaust duct 33 into an upwind side space and a downwind side space. For example, the partition plate 35 is made of resin, metal or other material and preferably has heat resistance. A height dimension of the partition plate 35 is smaller than a half of a length dimension of the lower part of the exhaust duct 33. In addition, as the partition plate 35 is located more backward, the height dimension of the partition plate 35 is made smaller. That is, in a cross-section of the exhaust duct 33, a cross-section (an exhaust cross-section) narrowed by the partition plates 35 is made narrowest by the partition plates 35 located at the most upward side in the exhaust direction A. The exhaust cross-section is widen gradually as the partition plates 35 is located nearer the filter 34 (at the more downward side). The partition plate 35 at the most upward side in the exhaust direction A is preferably arranged to the inner face near the inside of the bent portion of the exhaust duct 33, i.e., on the upper inner face of the exhaust duct 33.

The plurality of the partition plates 35 is formed so as to incline at least partially in an opposite direction to the exhaust direction A. The inclined part and the exhaust direction A form an obtuse angle as viewed from the upwind side in the exhaust direction A. For example, the partition plate 35 is stood vertically on the upper inner face and lower inner face and formed by bending the distal end at an angle of 45 degrees in the opposite direction to the exhaust direction A.

The heating member 36 is, for example, a heater, such as a halogen heater or an electric heater, and attached to the back side (the exhaust direction A's side) of the partition plate 35. The heating member 36 is configured to heat at least a front side face (an opposite direction's side face to the exhaust direction A) of the partition plate 35.

The filter 34 is a filtering member filtering and ejecting the flowed air, for example, to catch the particulates, such as an ink or a toner, in the air and to allow passage of cleaned air. The filter 34 is attached to the back face of the printer main body 2 so as to eject the filtered air outside the printer main body 2.

In an intermediate lower part of the printer main body 2, a pair of left and right elevating devices 18 is attached below the conveying unit 8. Each elevating device 18 includes a rotation axis 20 and a cam 21 supported by the rotation axis 20. The cam 21 is connected with a driving device (not shown), such as a driving motor. Accordingly, by activating the driving device, each cam 21 rotates around the rotation axis 20 so that a posture of the cam 21 is switched between an upright posture (refer to solid line in FIG. 1) and a laid-down posture (refer to two-dot chain line in FIG. 1). The cam 21 is switched to the upright posture to lift up the conveyance frame 10 and to move the conveying unit 8 upward or switched to the laid-down posture to release the lift of the conveyance frame 10 and to move the conveying unit 8 downward.

In the intermediate part of the printer main body 2, four recording heads 22 (22K, 22C, 22M, 22Y) are arranged in parallel above the conveying unit 8. The recording heads 22 correspond to black (K), cyan (C), magenta (M) and yellow (Y) from an upstream side (a right side in the embodiment) in order of a conveying direction of the sheet P. Hereinafter, except for the description to be specified by the colors, the reference characters "K", "C", "M" and "Y" with regard to the recording heads 22 are omitted. The recording heads 22 are provided with respective nozzles (not shown) facing to the conveyance face 17 of the conveyance belt 14.

In the upper part of the printer main body 2, four ink containers 23 (23K, 23C, 23M, 23Y) are installed in parallel attachably/detachably in forward and backward directions. The four ink containers 23 are provided for each ink color to store respective inks of black (K), cyan (C), magenta (M) and yellow (Y) from an upstream side (a right side in the embodiment) in order of the conveying direction of the sheet P. Hereinafter, except for the description to be specified by the colors, the reference characters "K", "C", "M" and "Y" with regard to the ink containers 23 are omitted.

Each ink container 23 is connected to each recording head 22 via a sub container 24. The ink contained in each ink container 23 is temporarily stored in the sub container 24, and then, supplied to each recording head 22. Incidentally, the sub container 24 is provided for each color of black (K), cyan (C), magenta (M) and yellow (Y) similarly to the recording head 22 and ink container 23. In FIG. 1, the sub container 24 corresponding to black (K) is illustrated and other sub containers 24 corresponding to other colors are omitted.

In a left side part of the printer main body 2, an ejecting mechanism 25 is arranged. The ejecting mechanism 25 includes a drying device 26, ejecting rollers 27 and a sheet ejected tray 30. The drying device 26 is located at the left upper side of the conveying unit 8. The ejecting rollers 27 are located at the left side of the drying device 26. The sheet ejected tray 30 is arranged below the ejecting rollers 27 and projected outside the printer main body 2 via an ejecting port 28.

Next, the operation of forming an image by the printer 1 having such a configuration will be described.

In the printer 1, when image data is received from an external computer or the like, the sheet P stored in the sheet feeding cartridge 3 is fed to the conveying path 4 by the sheet feeding roller 5. The sheet P fed to the conveying path 4 is conveyed to a downstream side of the conveying path 4 by the conveying rollers 6 and fed from the conveying path 4 to the conveyance face 17 of the conveyance belt 14 by the resist rollers 7.

At this time, the fan 32 of the sucking part 15 is activated to suck the air from the surface side of the conveyance face 17 of the conveyance belt 14 to the sucking part 15 via the intake holes of the conveyance belt 14 and the openings of the sucking part 15. The sheet P fed to the conveyance face 17 of the conveyance belt 14 is absorbed to the conveyance face 17 of the conveyance belt 14 by suction force of the sucking part 15.

On the other hand, to each recording head 22, the ink is supplied from each ink container 23. Each recording head 22 discharges the ink to the absorbed sheet P on the conveyance face 17 on the basis of the information of the image data received from the external computer or the like. Thereby, a color ink image is formed on the sheet P. The sheet P having the color ink image is advanced so that the ink on the surface is dried by the drying device 26, and then, ejected on the ejected sheet tray 30 via the ejecting port 28 by the ejecting rollers 27.

In the present embodiment, as mentioned above, since the exhaust cross-section in the exhaust duct 33 is narrowed by the partition plates 35 and the distal end of the partition plate 35 is inclined in the opposite direction to the exhaust direction A, the speed of the air coming into the air path narrowed by the partition plates is increased. Therefore, the vortex can be easily generated at an opposite side to the exhaust direction A's side the partition plate 35, and then, the particulates floated in the air can be collected easily and securely by the inclined partition plate 35. Accordingly, since the particulates reached the filter 34 can be decreased, the particulates can be caught easily by the filter 34. Thus, the exhaust part 16 can eject the particulates in the air after the particulates are caught easily and securely by means of the plurality of the partition plates 35 and filter 34. In addition, the inclined parts of the alternately arranged partition plates 35 adjust the air speed in the exhaust duct 33, and particularly, the partition plates 35 inclined in the opposite direction to the exhaust direction decrease the air speed. Accordingly, since the air speed from the exhaust duct 33 to the filter 34 is decreased, damage of the filter 34 by impact of the particulates can be restrained and clogging of the filter 34 by the particulates can be restrained, and then, it is possible to elongate lifetime of the filter 34.

In addition, the plurality of sets of the partition plates 35 closely arranged along the exhaust direction A on the upper inner face and lower inner face are inclined in the opposite direction to the exhaust direction A. A gap (the exhaust cross-section) between each set of the partition plates 35 has a more reduced diameter at a nearer side to an inlet and a more enlarged diameter at a nearer side to an outlet. Therefore, the speed of the air passing through this gap can be increased at the inlet side and decreased at the outlet side.

Moreover, in the present embodiment, at the more upwind side in the exhaust direction A of the exhaust duct 33, the height dimension of the partition plate 35 located here is made larger and the gap between the set of the partition plate 35 located on the upper inner face and lower inner face of the exhaust duct 33 is made narrower. Therefore, the speed of the air coming into this gap can be increased.

By contrast, at the more downwind side in the exhaust direction A in the exhaust duct 33, the height dimension of the partition plate 35 is made smaller and the gap between the set of the partition plate 35 located on the upper inner face and lower inner face is made wider (the exhaust cross-section is made wider). Therefore, the speed of the air coming into this gap can be more decreased at the more downwind side in the exhaust direction A. Thereby, it is possible to sufficiently secure the air path in the exhaust duct 33 and to restrain the pressure drop caused by the partition plates 35.

The air path in the exhaust duct 33 is finally widened to the same cross-section as the filter 34 and communicated with the filter 34, and then, the air speed is further decreased just before the filter 34. Accordingly, if the suction force of the sucking part 15 is strengthened to increase the air speed at the sucking part 15's side in order to absorb the sheet P to the conveyance face 17 of the conveyance belt 14, it is possible to appropriately decrease the air speed and to send the air to the filter 34. Therefore, it is unnecessary to weaken the suction force of the sucking part 15 and it is possible to appropriately absorb the sheet P to the conveyance face 17 of the conveyance belt 14.

Thus, since, by decreasing the speed of the air passing through the exhaust duct 33, the particulates can be easily dropped, it is possible to catch easily and securely the particulates by the filter 34. Moreover, since the particulates enter the filter 34 after the speed reduction, the damage of the filter by the impact of the particulates can be restrained, and then, it is possible to elongate the lifetime of the filter 34.

Figure 4:
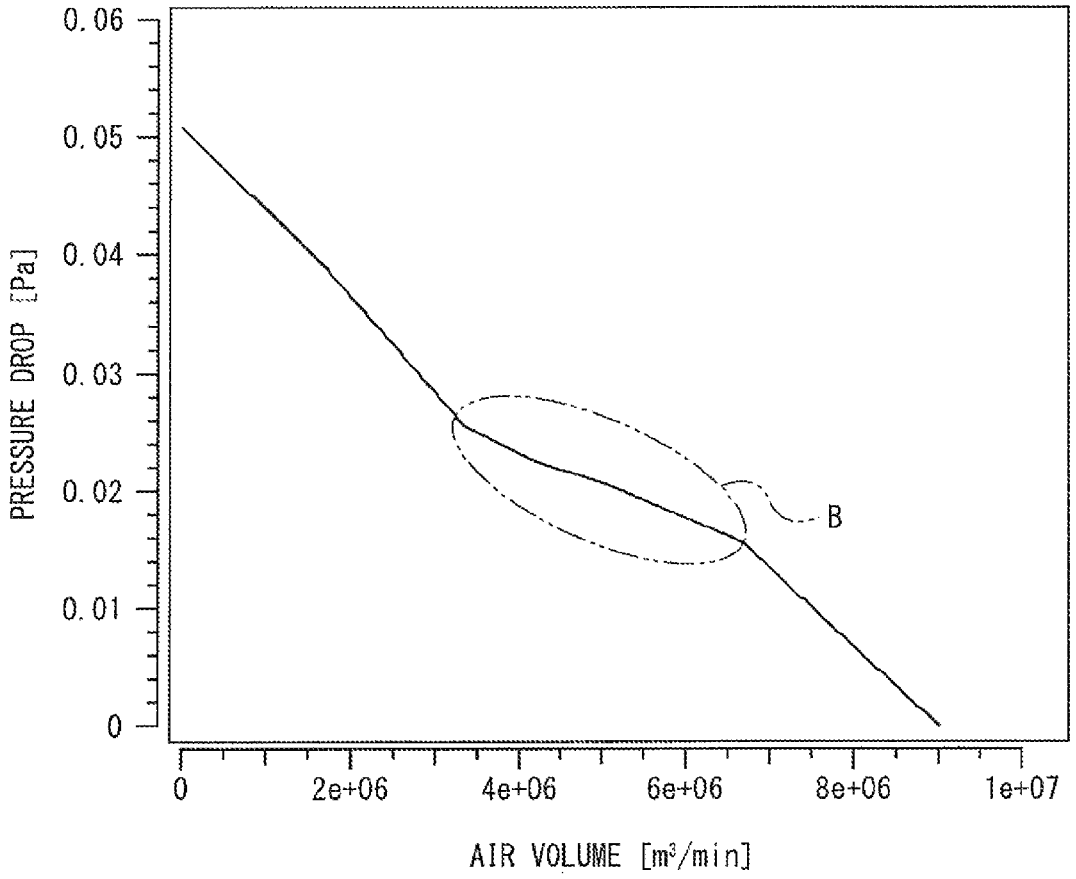
FIG. 4 is a graph plotting relationship between air volume and pressure drop with regard to an exhaust in a printer.

In addition, according to the present embodiment, in the lower part of the exhaust duct 33, the gap between each set of the partition plates 35 is narrowed, while, in the center of the exhaust duct orthogonal to the exhaust direction A, i.e., in the vicinity of the center of the exhaust duct, the air path is maintained. Moreover, at the upwind side in the exhaust direction A, the gap between the partition plates 35 is narrow, while the gap between the partition plates 35 is made wider at the more downwind side. Therefore, it is possible to restrain the pressure drop caused by the partition plates 35 against the air flowing in the exhaust duct 33. Thereby, it is unnecessary to increase the air volume of the fan 32 in order to reduce the pressure drop and it is possible to save the energy for the activation of the fan 32 and to reduce the noise of the fan 32. Accordingly, it is possible to apply the fan 32 so that the air volume and pressure drop are regulated within an ideal balanced range, for example, within a range B shown in FIG. 4. Furthermore, it is unnecessary to enlarge the exhaust duct 33 in order to reduce the pressure drop and it is possible to save spaces.

Thus, in the image forming apparatus of the present embodiment, it is possible to appropriately catch the particulates, such as the ink or toner, in the middle of the air path of the exhaust duct 33 and to reduce the speed of the air flowing to the filter 34.

Further, since the partition plate 35 located at the most upwind side is arranged on the upper inner face at the nearest side to the bent portion of the exhaust duct 33, it is possible to easily involve the air passing through this bent portion by the first partition plate 35, and then, to catch more particulates in the air.

In addition, by reason of attaching the heating member 36 to the partition plate 35 to heat at least the front side face (the opposite direction's side face to the exhaust direction A) of the partition plate 35, if the particulates caught by the partition plate 35 are the ink, it is possible to evaporate moisture in the ink and to make the ink adhere to the partition plate 35. By the same reason, if the particulates caught by the partition plate 35 are the toner, it is possible to solve the toner and prevent from blowing the toner off.

Figure 6:
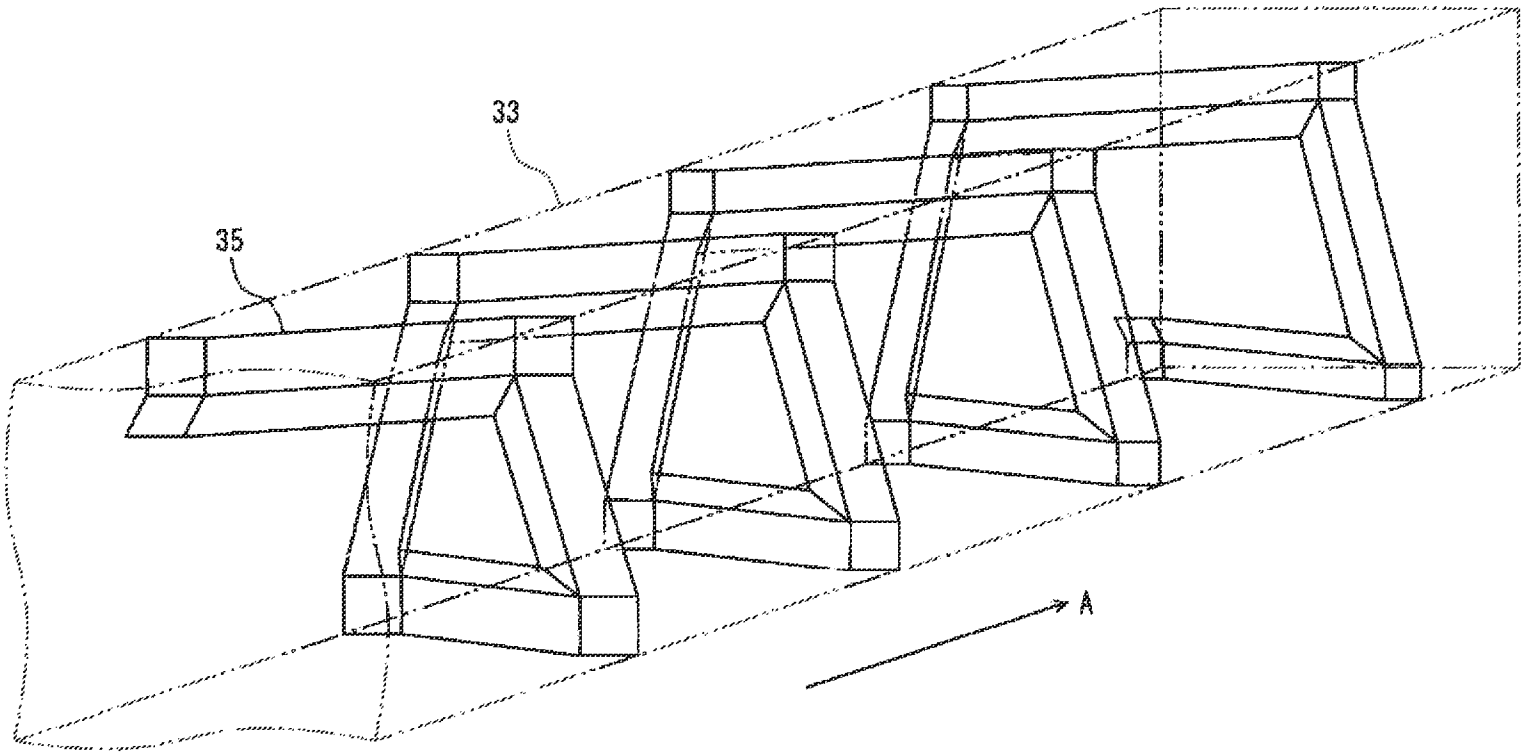
FIG. 6 is a perspective view of schematically showing the partition plate in an exhaust duct in the printer according to the embodiment of the present disclosure.

Although, in the present embodiment, a configuration of arranging the plurality of the partition plates 35 on the upper inner face and lower inner face of the exhaust duct 33 is described, the partition plates 35 are not restricted to this configuration. For example, in another embodiment, as shown in FIG. 6, the partition plate 35 may be made of one helical plate member surroundingly provided along the inner circumferential face of the exhaust duct 33 and extending in the exhaust direction A so as to be alternately arranged on the upper inner face and lower inner face of the exhaust duct 33. The one plate member has a tapered shape from the upwind side to the downwind side in the exhaust direction A. Thereby, it is possible to reduce the number of components and attachment man-hour for the partition plate 35, and to decrease manufacturing cost.

Figure 5:
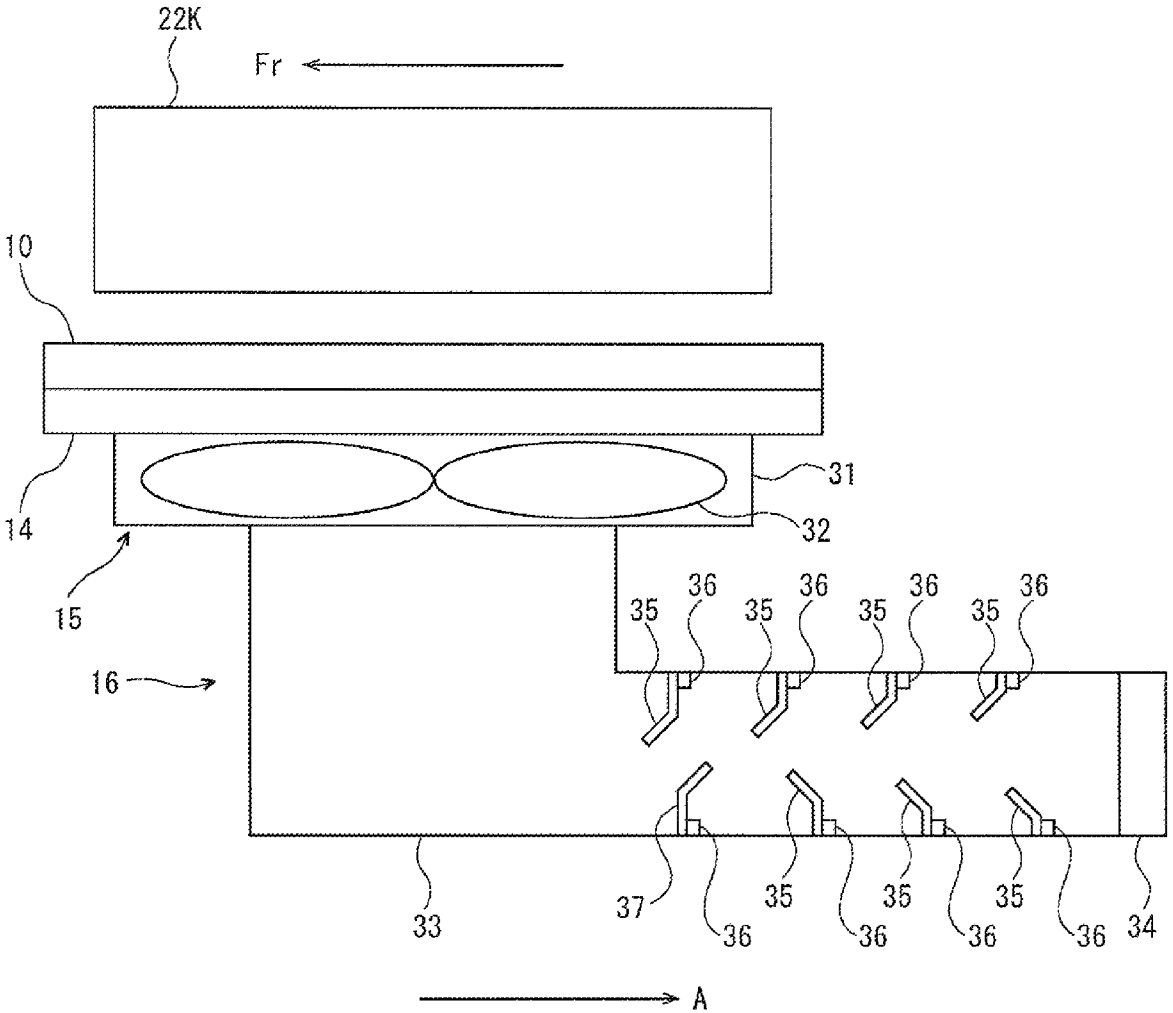
FIG. 5 is a rightward sectional view schematically showing the mechanism in the vicinity of the exhaust part of the printer according to another embodiment of the present disclosure.

In addition, in the present embodiment, a configuration of forming the plurality of the partition plates 35 so as to incline in the opposite direction to the exhaust direction A is described, the plurality of the partition plates 35 are not restricted to this configuration. For example, in another embodiment, as shown in FIG. 5, the second nearest partition plate 37 to the front side (to the upwind side in the exhaust direction A) is formed so as to incline at least partially in the exhaust direction A. The inclined part and the exhaust direction A form an acute angle as viewed from the upwind side in the exhaust direction A. The other partition plates 35 are formed to so as to incline in the opposite direction to the exhaust direction A. That is, one set of the partition plate 35 and partition plate 37 arranged on the upper inner face and lower inner face at the most upwind side in the exhaust direction A have respective distal ends directing in different directions.

Since the lower partition plate 37 in such a first set has the exhaust cross-section widened at the opposite direction's side to the exhaust direction A, the air can be smoothly taken in. Moreover, since the exhaust cross-section of the lower partition plate 37 is made narrower in the exhaust direction A, the air can be smoothly flowed to the center of the exhaust duct 33. Even if such a configuration is applied, since the other partition plates 35 except for the second nearest partition plate 37 to the upwind side is formed so as to incline in the opposite direction to the exhaust direction A, the particulates in the air can be sufficiently caught. In addition, by the second or later sets of the upper and lower partition plates 35, the air speed can be sufficiently reduced.

Incidentally, the partition plate 37 inclined in the exhaust direction A to smoothly take the air in is not restricted by that arranged at the second nearest position to the upwind side. The partition plate 37 may be arranged another appropriate position for smoothly taking the air in.

Although, in the above-mentioned embodiments, a configuration of inclining at least respective parts, for example, the respective distal ends, of the partition plates 35 and partition plate 37 against the exhaust direction A is described, the whole partition plates 35 and partition plate 37 may be inclined against the exhaust direction A.

Although, in the present embodiment, a configuration of attaching the heating member 36 to the partition plate 35 is described, a configuration of aiding the catch of the particulates is not restricted to this. For example, in another embodiment, a sponge or the like, to which the particulates is easily adhered, may be attached as a catch aiding member at the front side (at the opposite direction's side to the exhaust direction A) of each partition plate 35. Thus, the particulates in the vortex air at the front side of the partition plate 35 can be adhered to the sponge, thereby aiding the catch, and then, it is possible to efficiently catch the particulates.

Alternatively, in a further embodiment, a charging member charging the metal partition plate 35 by voltage with reversed polarity to polarity of the particulates, such as the toner, may be connected to the partition plate 35. Thus, the particulates can be attracted to the charged partition plate, thereby aiding the catch, and then, it is possible to efficiently catch the particulates.

Although, in the embodiments, configurations of the disclosure are applied to the printer 1, in a different embodiment, the ideas of the disclosure may be applied to a different image forming apparatus, such as a copying machine, a facsimile or a multifunction machine. In addition, although, in the embodiments, configurations of the disclosure are applied to the printer 1 as the image forming apparatus using the ink, in a different embodiment, the ideas of the disclosure may be applied to a different image forming apparatus using another developer, such as the toner, without being restricted by the image forming apparatus using the ink. Moreover, although, in the embodiments, configurations of the disclosure are applied to the exhaust duct ejecting the air in accordance with the suction of the sheet, in a different embodiment, the ideas of the disclosure may be applied to a different exhaust duct provided in the image forming apparatus or a further different exhaust duct provided in another device except for the image forming apparatus.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a filter filtering and ejecting an air; and an exhaust duct flowing and ejecting the air to the filter, wherein the exhaust duct includes a partition plate made of one helical plate member provided on the inner circumferential face of the exhaust duct so as to extend along the inner circumference of the exhaust duct and in the exhaust direction, the partition plate being formed so as to incline in an opposite direction to the exhaust direction, the exhaust duct is further formed by bending in the middle, and the partition plate is arranged at the downwind side in the exhaust direction from the bent portion of the exhaust duct and an end of the partition plate at the most upwind side is provided near an innermost course in the bent portion.

2. The image forming apparatus according to claim 1, wherein the partition plate has a dimension made smaller at the more downwind side in the exhaust direction and an exhaust cross-section of the exhaust duct is made wider at the more downwind side in the exhaust direction.

3. The image forming apparatus according to claim 1, wherein the partition plate has a heating member heating an opposite side face to the exhaust direction side face of the partition plate.

4. The image forming apparatus according to claim 1, wherein the partition plate has a catch aiding member allowing adhesion of a particulate at an opposite side face to the exhaust direction side face of the partition plate.

5. The image forming apparatus according to claim 1, wherein the partition plate is made of metal material and connected to a charging member charging by voltage with reversed polarity to polarity of a particulate.

* * * * *